US008558745B2

(12) United States Patent
Habib et al.

(10) Patent No.: US 8,558,745 B2
(45) Date of Patent: Oct. 15, 2013

(54) TERAHERTZ ANTENNA ARRANGEMENT

(75) Inventors: Laurent Habib, Moshav Shapira (IL); Ron Daisy, Raanana (IL)

(73) Assignee: Novatrans Group SA, Vaumarcus (NE) (CH)

( * ) Notice: Subject to any disclaimer, the term of this patent is extended or adjusted under 35 U.S.C. 154(b) by 214 days.

(21) Appl. No.: 13/229,932

(22) Filed: Sep. 12, 2011

(65) Prior Publication Data

US 2012/0092223 A1 Apr. 19, 2012

Related U.S. Application Data

(60) Provisional application No. 61/392,663, filed on Oct. 13, 2010.

(51) Int. Cl.
*H01Q 19/06* (2006.01)

(52) U.S. Cl.
USPC ..... 343/753; 343/731

(58) Field of Classification Search
USPC ..... 343/731, 700 MS, 753, 754
See application file for complete search history.

(56) References Cited

U.S. PATENT DOCUMENTS

| | | | | |
|---|---|---|---|---|
| 4,833,482 | A * | 5/1989 | Trinh et al. | 343/700 MS |
| 5,210,541 | A * | 5/1993 | Hall et al. | 343/700 MS |
| 5,367,307 | A * | 11/1994 | Dupuis et al. | 343/700 MS |
| 6,424,298 | B1 * | 7/2002 | Nishikawa et al. | 343/700 MS |
| 2006/0152412 | A1 * | 7/2006 | Evans et al. | 343/700 MS |

* cited by examiner

*Primary Examiner* — Hoanganh Le
(74) *Attorney, Agent, or Firm* — Mark A. Friedman

(57) ABSTRACT

An antenna arrangement for generating and receiving terahertz radiation is described. The arrangement comprises a substrate comprising a photoconductive material and a pair of electrodes provided on the photoconductive material. Each electrode includes a plurality of elongate fingers spaced apart from each other which are arranged in a parallel relation and define finger gaps therebetween. The fingers of one electrode are located within the finger gaps formed between the spaced apart fingers of another electrode so that two neighboring fingers belong to different electrodes. The fingers of each electrode have at least one protrusion extending away from lateral sides of the fingers within the finger gap. Each protrusion is slanted with respect to the corresponding finger direction, and directed towards a neighboring slanted protrusion extending from the neighboring finger such that end edges of the neighboring protrusions extending from the neighboring fingers approximately face one another, thereby defining a protrusion gap between end edges of the facing protrusions.

16 Claims, 8 Drawing Sheets

30B

TERAHERTZ ANTENNA ARRANGEMENT

FIELD OF THE INVENTION

The present invention relates generally to devices for generating and receiving electromagnetic radiation, and in particular, to an interdigital antenna arrangement for generating and receiving terahertz (THz) frequency range radiation.

BACKGROUND OF THE INVENTION

There are many applications using terahertz (THz) frequency range radiation. For example, THz radiation can be used for characterization of a variety of properties of solid and liquid materials, such as photoconductivity, dispersion, absorption, refractive index, etc. THz radiation can penetrate dry, non-metallic and non-polar objects like plastic, paper, textiles, cardboard, semiconductors and non-polar organic substances, therefore THz radiation can be used for safe package inspection instead of x-rays, e.g., to look inside boxes, cases etc. THz radiation can also be used for industrial process control, food inspection, biology and medicine.

THz radiation may be generated or detected using so-called photoconductive antennas, which comprise two electrodes provided on the surface of a photoconductive substrate. To generate radiation such an antenna can, for example, be excited by directing a light pulse onto such a device. When a bias voltage is applied to the electrodes, a photogenerated current flows between the electrodes, which in turn results in the emission of broadband radiation with frequencies up to the THz range. Alternatively, the pulse laser pump can be replaced with two CW lasers of slightly different frequencies so that when mixed in the active region of the photoconductor they produce a mixing signal also in the THz range.

Materials suitable for the photoconductive substrate are typically semiconductor materials which are grown at low temperatures (typically 200° C.-300° C. rather than the more usual growth temperatures in the region of 600° C.), or materials which have been implanted with ions after growth. Examples of such materials include, but are not limited to, low temperature GaAs (denoted LT GaAs), arsenic implanted GaAs (As—GaAs), LT InGaAs, and LT AlGaAs.

A typical prior art arrangement 10 for generation of THz radiation is shown in FIG. 1. The arrangement includes two strip electrodes 11, 12 mounted on a photoconductive substrate 13 and interconnected with DC bias source 14. The strip electrodes 11, 12 are provided with protrusions 15, 16 facing each other, thereby defining an electrode gap 17 therebetween, which is the active region of the device when illuminated with a light beam 18. As shown in FIG. 1, the protrusions 15, 16 are formed as planar rectangular strip elements with flat edges, however more sophisticated shapes for the strip elements are also known.

For example U.S. Pat. No. 5,729,017 describes pulse generators and detectors for operating at frequencies of the order of $10^{10}$ to $10^{13}$ Hz (the Terahertz range). These devices rely on electric field interactions with optical beams in biased metal semiconductor microstructures. An electric field is created between metal electrodes on the semiconductor surface and the electric field is enhanced by configuring the electrode gap geometry with sharp electrode features.

THz antennas, in which the electrodes are provided as interdigital arrangement, are known. Referring to FIG. 2, a typical interdigital antenna arrangement 20 is illustrated. The inter-digital antenna arrangement 20 comprises first and second electrodes 21 and 22 with interdigital finger structure mounted on a photoconductive substrate 23. The first electrode 21 comprises a planar main body including a plurality of elongate fingers 24 connected to the electrode's main body 21. The electrode's main body 21 and the elongate fingers 24 form a continuous metallic planar structure. A second electrode 22 is identical to the first electrode 21, but is arranged at 180° with respect to the first electrode 21. The second electrode 22 has corresponding fingers 25. The elongate electrode fingers 24 and 25 are of a width and are spaced apart such that the elongate fingers 24 of the first and electrode 21 can fit within the gaps provided between spaced apart fingers 25 of the second electrode 22. Thus, the contacts are interdigitated due to the interleaving of the electrode fingers.

Since the neighboring fingers 24 and 25 in the antenna arrangement 20 are biased with reciprocal polarity, a direction of a current (shown by a reference numeral 26) flowing in the photoconducting material between two certain neighboring fingers 24 and 25 arranged in the finger array is opposite to the direction of a current (shown by a reference numeral 27) flowing in the photoconducting material between two next neighboring fingers 24 and 25. A problem with these current opposite directions is coherent signal cancellation in the interdigital arrangement 20, and accordingly there is a need for decoupling of the individual fingers 24 and 25 as radiating elements of the arrangement 20, in order to prevent destructive interference of the THz distant fields.

In order to solve the problem of the coherent signal cancellation in an interdigital arrangement, in German patent DE 10 2004 046 123 A1, an interdigital structure was proposed to increase the radiancy of the terahertz radiation emitted by a photoconductive antenna, which has every second finger structure covered by a layer impermeable to the exciting laser light. In this structure, the terahertz waves emitted between the fingers of the interdigital structure have uniform polarisation orientation and constructively overlap in the far field.

German patent No. 10 2006 059 573 describes a THz arrangement in which the optical excitation of the charge carriers in the photoconductive material is limited to every second finger of the inter-digital finger array structure. In order to limit this excitation, the arrangement includes a lens array. The focal points of the individual lenses of the lens array are all located at the surface of the semiconductor material between every second finger of the interdigital finger structure.

International patent application WO2007/112925 describes an antenna array having a plurality of THz antennae. The lateral regions between neighbouring THz antennae are practically free of photoconductive material to prevent occurrence of current between the antennae.

SUMMARY OF THE INVENTION

Despite the prior art in the area of interdigital antenna arrangement for receiving terahertz (THz) radiation, there is still a need in the art for further improvement of performance of prior art antennas. The present invention partially eliminates disadvantages of the prior art antenna techniques and provides a novel antenna arrangement for generating and receiving terahertz radiation.

According to one embodiment, of the present invention, the arrangement comprises a substrate comprising a photoconductive material and a pair of electrodes provided on the photoconductive material. Each electrode includes a plurality of elongate fingers spaced apart from each other which are arranged in a parallel relation and define finger gaps therebetween. The fingers of one electrode are located within the finger gaps formed between the spaced apart fingers of another electrode so that two neighboring fingers belong to different electrodes. The fingers of each electrode have at least one protrusion extending away from lateral sides of the fingers within the finger gap.

According to an embodiment of the present invention, each protrusion is slanted with respect to the corresponding finger direction, and directed towards a neighboring slanted protrusion extending from the neighboring finger such that end edges of the neighboring protrusions extending from the neighboring fingers approximately face one another, thereby defining a protrusion gap between end edges of the facing protrusions.

According to an embodiment, wherein for each finger gap the protrusions located therewithin are slanted in opposite directions than the protrusions located within the neighboring (i.e., adjacent) finger gaps. For example, the protrusions extending from two neighboring fingers can be slanted 45 degrees and 135 degrees, correspondingly, with respect to the direction of the elongate fingers, although other angles are contemplated.

According to an embodiment of the present invention, at least a part of the end edge of the protrusion extending away from a certain finger extends over at least a part of the end edge of the facing protrusion extending away from the adjacent finger.

According to one embodiment of the present invention, a place from which the protrusions extend from one lateral side of the fingers is shifted with respect to the place on the fingers from which the protrusions extend from another lateral side of the fingers.

According to another embodiment of the present invention, a place from which the protrusions extend from one lateral side of the fingers is the same for the protrusions extending from both lateral sides of the fingers.

According to an embodiment of the present invention, the fingers and the protrusions are planar strips provided on the planar surface of the substrate.

According to an embodiment of the present invention, the protrusions have a trapezoidal shape including a beveled end edge.

According to an embodiment of the present invention, the beveled end edge of the protrusion extending away from a certain finger extends over a beveled end edge of the neighboring protrusion extending away from the neighboring finger such that the beveled end edges corresponding to the neighboring protrusion approximately face one another.

According to an embodiment of the present invention, a width of the protrusions is greater than the width of the fingers.

According to a further embodiment of the present invention, the antenna arrangement further comprises a lens array located above the corresponding protrusion gap between the protrusions of the fingers. The lens array can be configured such that focal points of the lenses are located in the center of the protrusion gaps.

According to one embodiment of the present invention, the lens array is impressed into a surface of a transparent plate that is placed above the antenna arrangement.

According to another embodiment of the present invention, the lens array includes plano-convex individual lenses mounted onto the antenna arrangement.

The antenna arrangement can further comprise a DC bias configured for biasing the pair of electrodes; and a light source configured to direct a light beam at least onto the protrusion gaps between end edges of the facing protrusions, thereby generating a THz radiation beam emitted from the protrusion gaps.

The antenna arrangement of the present invention has many of the advantages of the prior art techniques, while simultaneously overcoming some of the disadvantages normally associated therewith.

The antenna arrangement according to the present invention can have an enhanced radiation efficiency.

It can be appreciated by a person of the art that the dipole antenna of the present invention may have numerous applications for various devices operating, for example, in the frequency band of about 0.5 THz to about 3 THz.

There has thus been outlined, rather broadly, the more important features of the invention so that the detailed description thereof that follows hereinafter may be better understood, and the present contribution to the art may be better appreciated. Additional details and advantages of the invention will be set forth in the detailed description.

BRIEF DESCRIPTION OF THE DRAWINGS

In order to understand the invention and to see how it may be carried out in practice, preferred embodiments will now be described, by way of non-limiting examples only, with reference to the accompanying drawings, in which.

DETAILED DESCRIPTION OF SPECIFIC EMBODIMENTS

The principles and operation of an interdigital antenna arrangement according to the present invention may be better understood with reference to the drawings and the accompanying description, it being understood that these drawings are given for illustrative purposes only and are not meant to be limiting. Examples of constructions, materials, dimensions, and manufacturing processes are provided for selected elements. Those versed in the art should appreciate that many of the examples provided have suitable alternatives which may be utilized.

Figure 1:
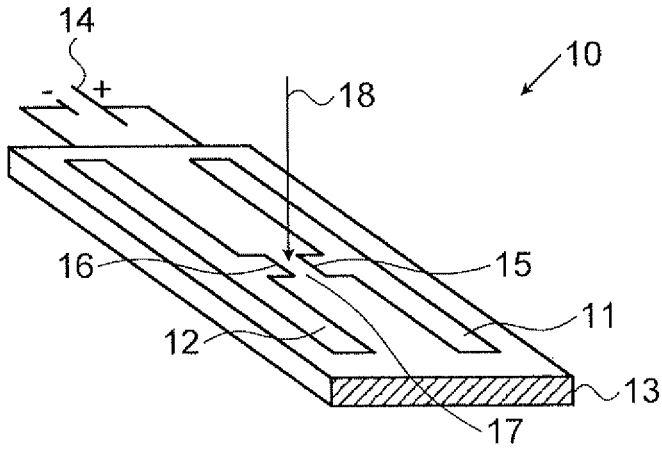
FIG. 1 (PRIOR ART)
FIG. 1 illustrates schematically an example of a prior art arrangement for generation of THz radiation.
Figure 2:
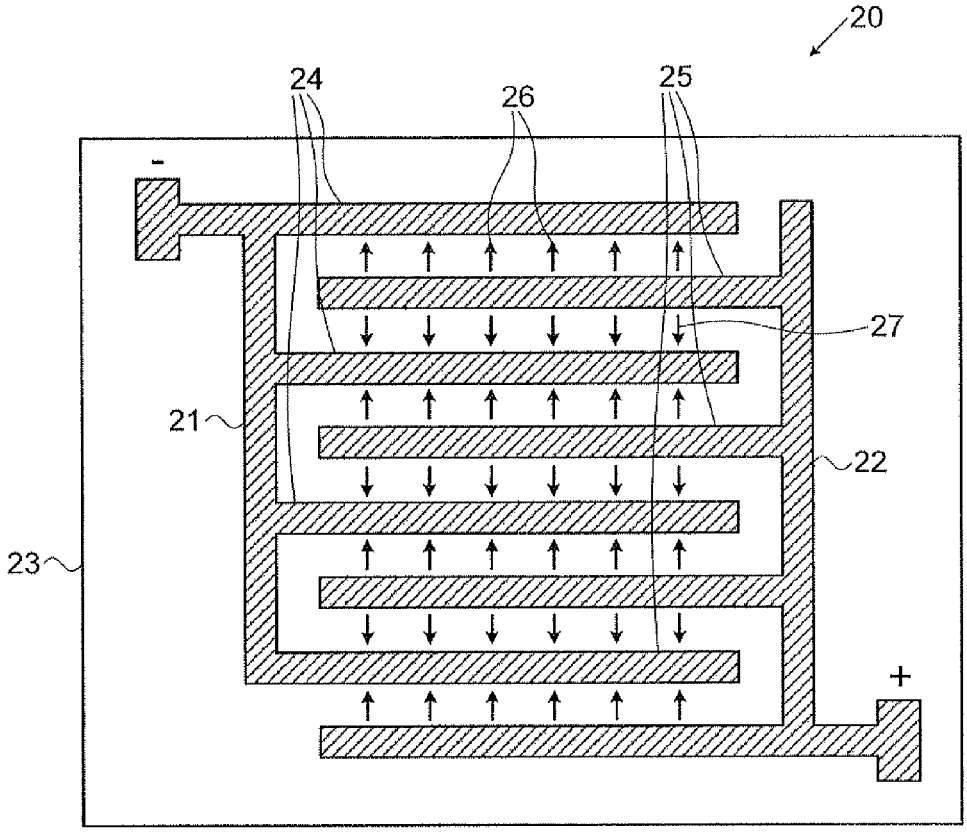
FIG. 2 (PRIOR ART)
FIG. 2 illustrates a schematic top plan view of a prior art interdigital antenna arrangement.
Figure 3A:
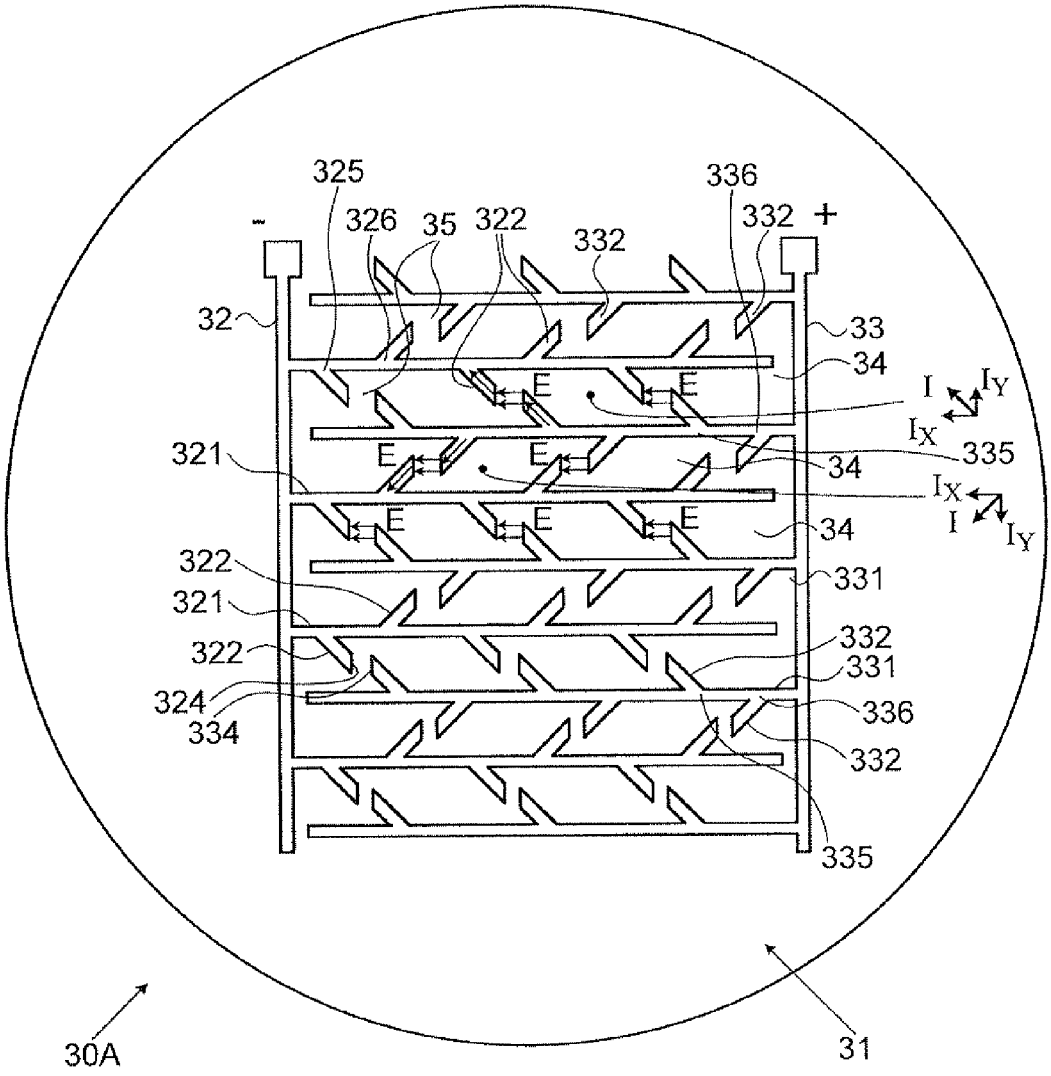
FIG. 3A is a top plan view of an antenna arrangement, according to one embodiment of the present invention.

Referring now to the drawings wherein like reference numerals designate corresponding parts throughout the several views, FIG. 3A illustrates a schematic view of an antenna arrangement 30A according to one embodiment of the present invention. It should be noted that this figure as well as further figures (illustrating other examples of the antenna of the present invention) are not to scale, and are not in proportion, for purposes of clarity.

The antenna arrangement 30A includes a substrate 31 comprising a photoconductive material, and a pair of electrodes 32, 33 provided on the photoconductive material. The electrodes 32, 33 include a plurality of elongate fingers 321, 331 spaced apart from each other. The fingers 321, 331 are arranged in a parallel relation and define finger gaps (i.e., areas between the fingers) 34 therebetween. The fingers 321 of the electrode 32 are located within the finger gaps 34 formed between the spaced apart fingers 331 of the electrode 33 so that two adjacent fingers belong to different electrodes.

According to an embodiment of the invention, the fingers 321, 331 have one or more protrusions 322, 332 extending away from lateral sides of the finger 321, 331 within the finger gaps 34 and slanted with respect to the finger direction. A direction in which the protrusions 322 are slanted is opposite to the direction in which the protrusions 332 are slanted. For example, the protrusions 322 can be slanted 45 degrees with respect to the direction of the elongate fingers 321. On the other hand, the protrusions 332 can, for example, be slanted 135 degrees with respect to the direction of the elongate fingers 331, although other slant angles could be used. Accordingly, the protrusions 322 extending from the finger 321 are directed towards a neighboring protrusion 332 extending from the adjacent finger 331.

According to the embodiment shown in FIG. 3A, the protrusions 322 and the protrusions 332 have a trapezoidal shape (i.e., a rectangle with beveled ends), although other shapes are also contemplated. According to the embodiment shown in FIG. 3A, a beveled end edge 324 of the protrusion 322 (extending away from the finger 321) extends over a beveled end edge 334 of the neighboring protrusion 332 (extending away from the neighboring finger 331) such that the beveled end edge 324 and the beveled end edge 334 approximately face one another, thereby defining a protrusion gap 35 between the end edges 324, 334 of the neighboring protrusions 322, 332. The protrusion gaps 35 between the end edges 324, 334 are the active sites of the antenna arrangement 30A.

The beveled end edges 324, 334 of the neighboring protrusions 322, 332 can, preferably, be at right angles with respect to the direction of the elongate fingers 321 and 331 although other angles could be used.

According to one embodiment, the electrodes 32, 33 are two planar electrodes provided as a conductive layer on the planar surface of the substrate 31 that comprises a photoconductive material. The fingers 321, 331 and the protrusions 322, 332 are planar strips provided on the planar surface of the substrate 31. The electrodes, fingers and protrusions may, for example, be made of aluminum, titanium-gold alloy, chromium, etc. Preferably, but not mandatory, a width of the protrusions 322, 332 would be greater than the width of the fingers 321, 331. For example, the width of the fingers 321, 331 can be in the range of 1 micrometer to 5 micrometers, whereas the width of the protrusions 322, 332 can be in the range of 5 micrometers to 10 micrometers. The width of the protrusion gaps 35 (i.e., spacing between the end edges 324, 334) should be less than the operation wavelength $\lambda$ of the antenna arrangement, and preferably less than $\lambda/10$.

The antenna arrangement 30A can be produced by using any standard lithography technique.

The photoconductive material may be selected from a wide variety of materials. Examples of such materials include, but are not limited to, low temperature grown GaAs (denoted LT GaAs), arsenic implanted GaAs (As—GaAs), LT InGaAs, and LT AlGaAs.

To generate radiation the antenna arrangement 30A can, for example, be excited by directing a light beam onto such a device. The light beam, can for example be formed by two CW lasers of slightly different frequencies so that when mixed they produce a mixing signal in the THz range. Alternatively, a femtosecond pulse laser operating at a wavelength of 500 nm to 2000 nm and a pulse duration of about 0.1-1 picoseconds or less can be used.

When a DC bias source (not shown) is applied to the electrodes 32, 33, a photogenerated current flows through the neighboring protrusions 322, 332 and within the protrusion gaps 35 between the end edges 324, 334 of the neighboring protrusions 322, 332, which in turn results in the emission of broadband radiation with frequencies that can reach and include the THz range. The DC bias for LT GaAs can, for example be about 5-200 volts depending on the size of the protrusion gaps 35 that can correspond to electric fields about 50 kV/cm.

Due to the slanted configuration of the protrusions 322, 332 extending away from long finger sides, the longitudinal component $I_x$ (parallel to the fingers 321, 331) of the current I flowing through the protrusions 322, 332 (as well as the electric field E generated within the protrusion gaps 35 between the end edges 324, 334 of the facing protrusions) has the same direction. On the other hand, the transverse components $I_y$ (orthogonal to the fingers 321, 331) of the current I flowing through the protrusion pairs 322, 332 located in a certain finger gap 34, is opposite to the $I_y$ component of the current I flowing through the protrusion pairs 322, 332 located at neighboring finger gap 34. Accordingly, the x-component of the THz radiation emitted by the entire antenna arrangement interferes constructively in the far field. Due to the destructive interference, the other component (namely, the y-component) has much smaller magnitude, and as a result, the polarization of the radiated field provided by the arrangement 30A is x-directed.

It should be noted that this is a substantial advantage of the antenna arrangement 30A over the prior art THz interdigital arrangements in which directions of an entire electric current between a certain finger and its neighbor from one side is opposite to the entire electric current direction between the finger and its neighbor from the other side. As can be understood, the antenna arrangement of the present application does not suffer from the problem associated with coherent signal cancellation in the prior art interdigital arrangement, and accordingly the need for decoupling of the individual fingers. Accordingly, contrary to the prior art interdigital arrangements, there is no need in the antenna arrangement of the present application to prevent destructive interference of the THz distant fields by covering every second finger structure by a layer impermeable to the exciting laser light, and/or by removing (e.g., etching) the region between every second pair of fingers for removing photoconductive material therefrom.

Thus, the antenna arrangement 30A can be more effective than the prior art arrangement, since it can include more radiating elements on an area unit. It should be understood that when the arrangement 30A is used as a phased array antenna, a more dense arrangement of the radiating elements can be obtained. This results in the fact that grating lobs can appear at much greater frequencies that enhances the performance of such an array antenna.

Figure 3B:
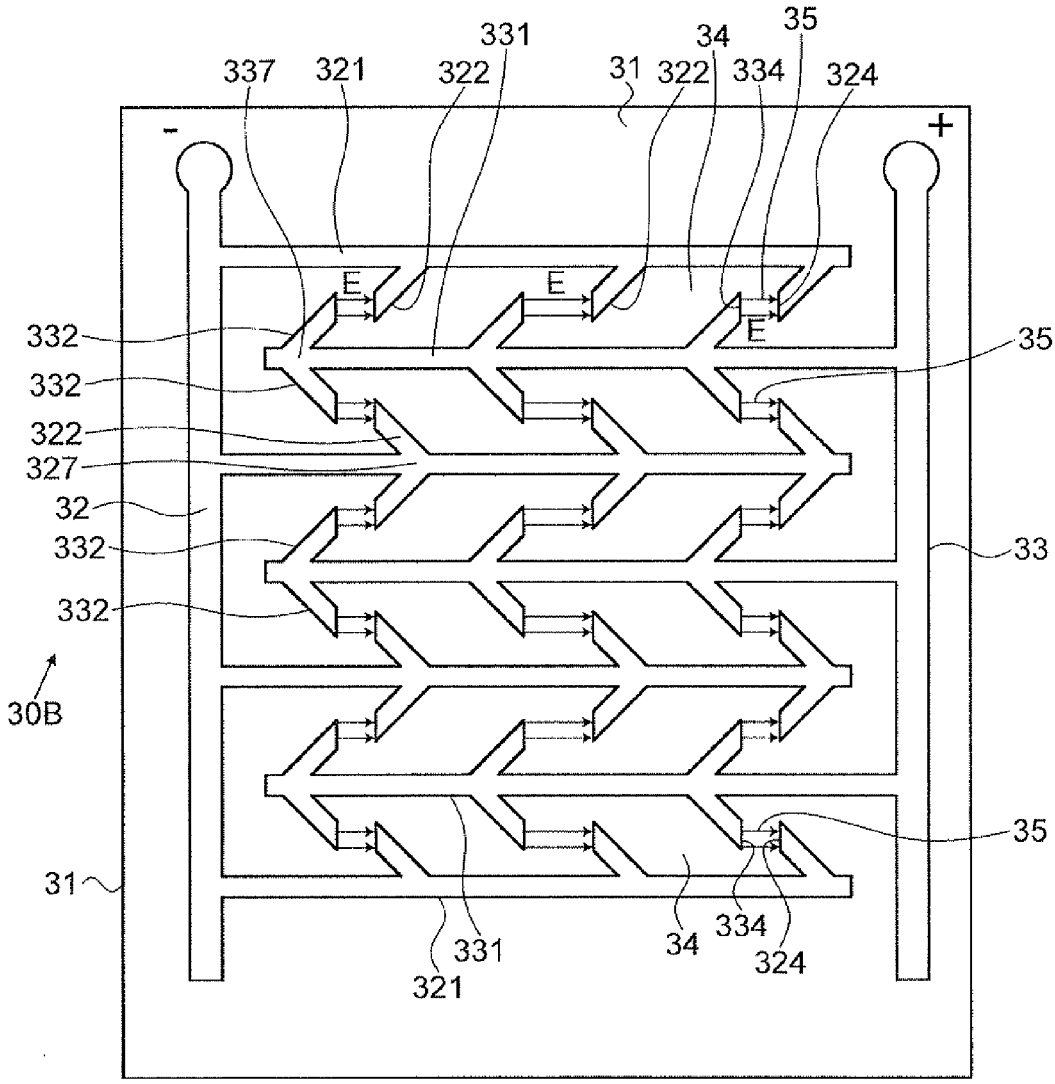
FIG. 3B is a top plan view of an antenna arrangement, according to another embodiment of the present invention.

As shown in FIG. 3A, a place 325 from which the protrusions 322 extend from one lateral side of the fingers 321 is shifted with respect to a place 326 from which the protrusions 322 extend from another lateral side of the fingers 321. Likewise, a place 335 from which the protrusions 332 extend from one lateral side of the fingers 331 is shifted with respect to a place 336 from which the protrusions 332 extend from another lateral side of the fingers 331, although other configurations are contemplated. For example, FIG. 38 illustrates a schematic view of the antenna arrangement 30B, according to another embodiment of the present invention, which differs from the antenna arrangement (30A in FIG. 3A) in the fact that the places 327 and 337 from which the protrusions extend from one lateral side of the fingers 321 and 331, correspondingly, is the same for the protrusions extending from another lateral side of the fingers. Moreover, it should be noted that the protrusions 322 and 332 extending from the fingers 321 and 331, correspondingly, are slanted in opposite directions, thus creating a shape of arrow (as shown in FIG. 3B).

Figure 4:
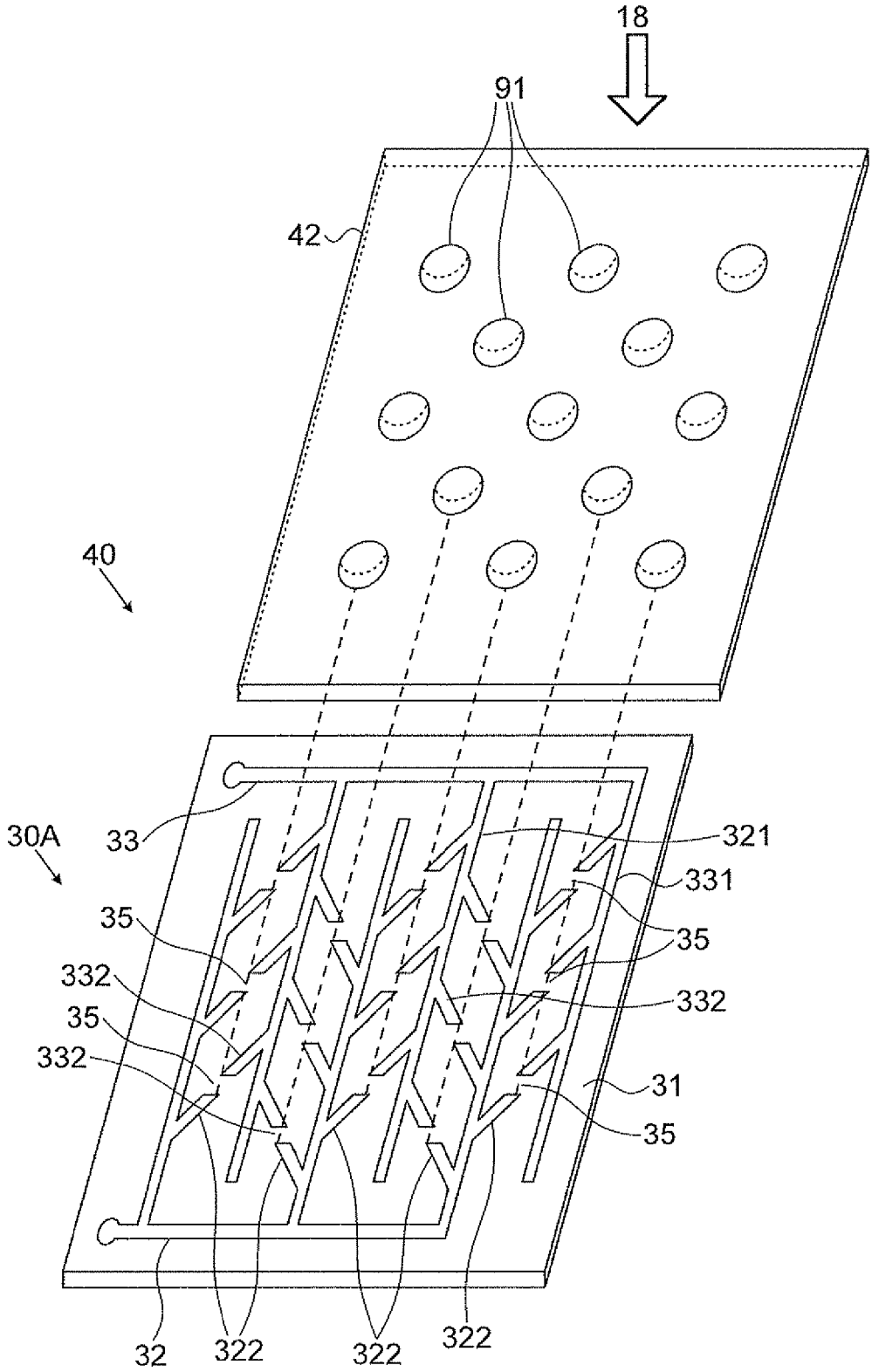
FIG. 4 is a perspective view of an antenna arrangement, according to a further embodiment of the present invention.

Referring to FIG. 4, an antenna arrangement 40 is illustrated, according to a further embodiment of the invention. The antenna arrangement 40 differs from the antenna arrangement (30A in FIG. 3A) in the fact that it further includes a lens array 41 that is made of glass, polymer or other suitable material. According to one embodiment, the lens array 41 is impressed into a surface of a transparent plate 42 that is placed above the antenna arrangement 30A. Alternatively, the lens array 41 can include plano-convex individual lenses mounted onto the antenna arrangement 30A.

Each lens is located above the corresponding protrusion gap 35 between the protrusions 322, 332 of the fingers 321, 331. The form of the lenses is chosen in such a way that the focal points of the lenses are located in the center of the protrusion gaps 35. Therefore, the charge carriers are generated by the laser light 18 mainly in the photoconductive material of the substrate 31 between the facing protrusions 322, 332.

It should be understood that antenna arrangement 40 can produce a higher radiation density (owing to focusing the laser radiation with the lens array) than in case of homogenous irradiation of the interdigital antenna arrangement. In particular, the efficiency of the terahertz radiation generation in relation to the available laser power can be increased by at least one order of magnitude.

According to a further embodiment of the invention, in order to increase radiation directivity a THz lens (not shown) can be attached to the non-metalized side of the substrate. The THz lens can, for example, be a hyper-hemispherical lens, designed such that the array phase center of the antenna arrangement is located at the aplanatic point (not shown) of the lens.

To demonstrate the performance of the antenna arrangement of the present application, computer simulations were carried out for an exemplary antenna arrangement of the present application and for a prior art interdigital antenna arrangement.

Figure 5:
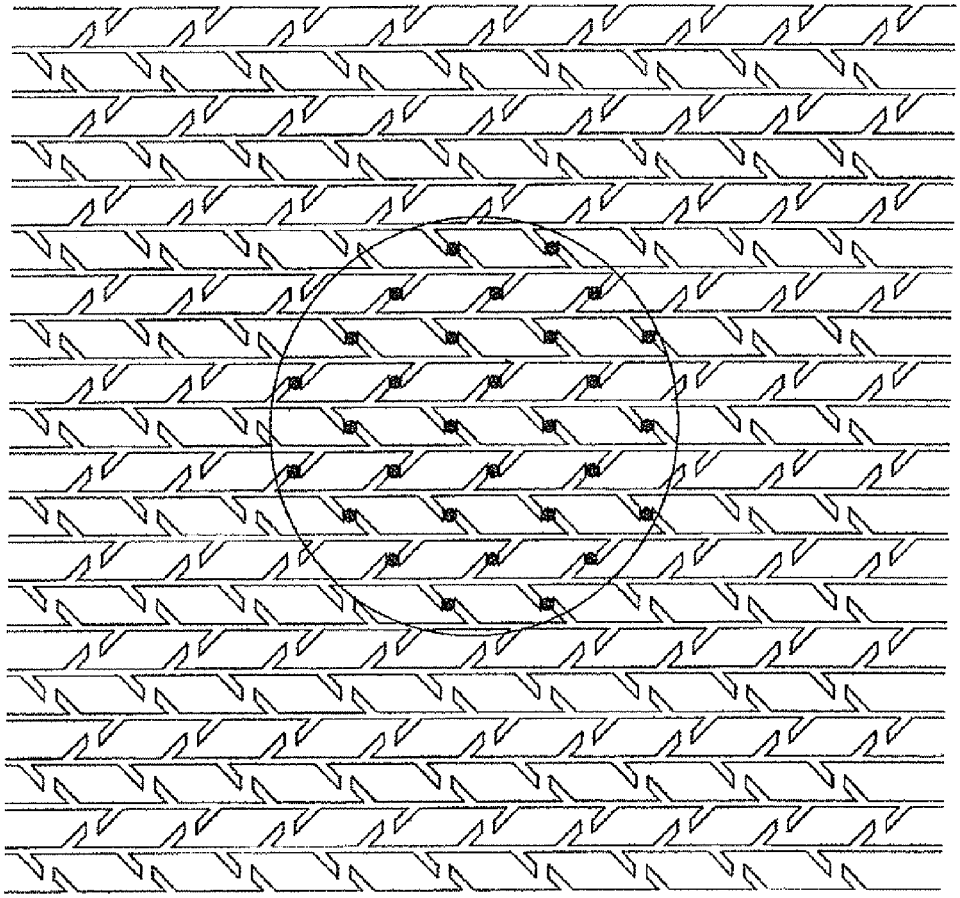
FIG. 5 illustrates an exemplary hexagonal array arrangement of the present invention selected for simulation.

Referring to FIG. 5, a hexagonal array arrangement having 750×750 μm elements occupation area and 350×350 μm illumination area were selected for the simulation. The substrate was 200 μm GaAs (lossless). The excited portion of the array arrangement comprises ten metal fingers with the numbers of slanted protrusions changing from two for the first and last fingers, and four for the middle fingers. The elements are arranged on an equilateral triangular grid having 30 micrometer edges.

Figure 6:
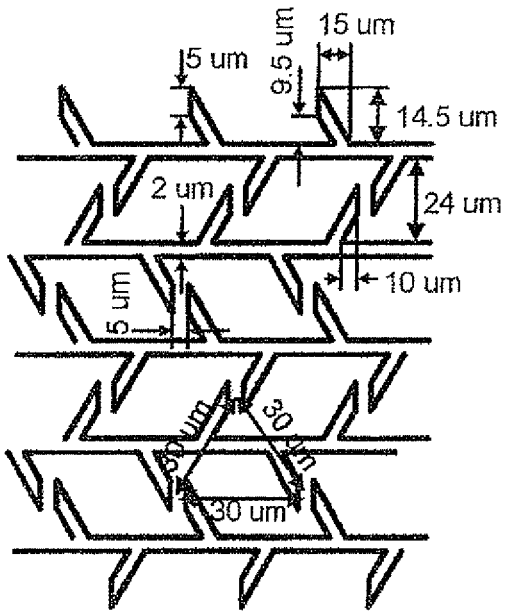
FIG. 6 illustrates characteristic dimensions of the exemplary antenna arrangement of FIG. 5 selected for simulation.

The characteristic dimensions of the simulated structure are shown in FIG. 6. Specifically, the width of the fingers was set to 2 micrometers, the width of the protrusions was set to 5 micrometers, the width of the finger gaps (i.e., the distance between the fingers) was set to 24 micrometers and the width of the protrusion gaps between the edges of the facing protrusions was set to 5 micrometers.

The prior art interdigital antenna arrangement used for the simulation represents a conventional inter-digital antenna arrangement without protrusions having metal fingers with a width of 8 micrometers and a distance between the fingers of 5 micrometers.

Figure 7:
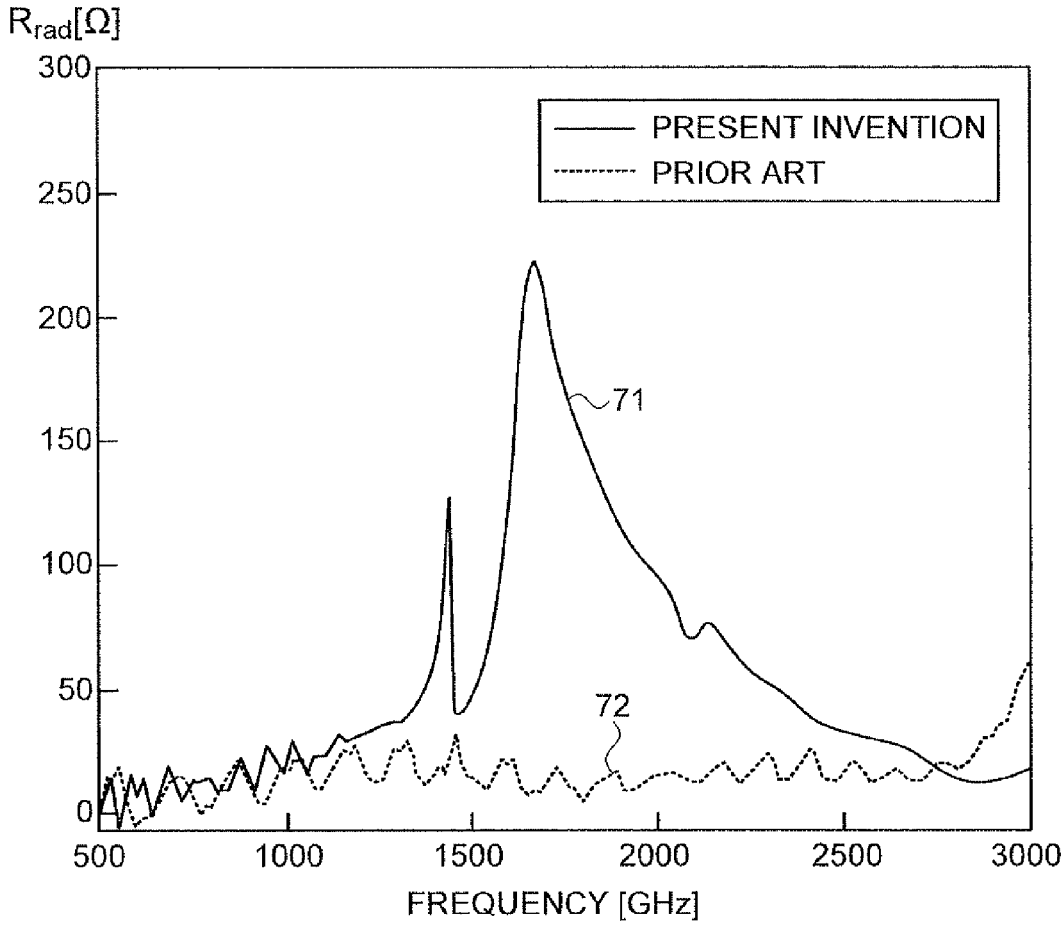
FIG. 7 illustrates exemplary graphs depicting the frequency dependence of the real part of the active impedance (i.e., radiation resistance) of the central antenna element port for an antenna arrangement of the present application, and for a prior art interdigital antenna arrangement.

FIG. 7 illustrates exemplary graphs depicting the frequency dependence of the real part of the active impedance of the central antenna element port for an antenna arrangement of the present application (see curve 71), and for a prior art interdigital antenna arrangement (see curve 72).

As can be seen in FIG. 7, the radiation resistance of the antenna arrangement of the present application is much greater than that obtained in the prior art one. This is an indication of the fact that the antenna arrangement of the present application provides much higher radiation efficiency in the relevant frequency range. This can stem from the fact that for the same surface area where the antenna arrangement is located, the radiating elements of the antenna arrangement of the present application are longer than the radiating elements of the prior art antenna arrangement. Specifically, in the present example, the radiating elements have an end-to-end length of 36 micrometers, compared to the 5 micrometers gap in the prior art interdigitated antenna arrangement.

As such, those skilled in the art to which the present invention pertains, can appreciate that while the present invention has been described in terms of preferred embodiments, the conception, upon which this disclosure is based, may readily be utilized as a basis for the designing of other structures systems and processes for carrying out the several purposes of the present invention.

It is to be understood that the phraseology and terminology employed herein are for the purpose of description and should not be regarded as limiting.

It is important, therefore, that the scope of the invention is not construed as being limited by the illustrative embodiments set forth herein. Other variations are possible within the scope of the present invention as defined in the appended claims. Other combinations and sub-combinations of features, functions, elements and/or properties may be claimed through amendment of the present claims or presentation of new claims in this or a related application. Such amended or new claims, whether they are directed to different combinations or directed to the same combinations, whether different, broader, narrower or equal in scope to the original claims, are also regarded as included within the subject matter of the present description.

The invention claimed is:

1. An antenna arrangement for generating and receiving terahertz radiation, comprising:

a substrate comprising a photoconductive material; and a pair of electrodes provided on the photoconductive material, each electrode of said pair of electrodes including a plurality of elongate fingers spaced apart from each other, arranged in a parallel relation and defining finger gaps therebetween, the fingers of one electrode of said pair of electrodes being located within the finger gaps formed between the spaced apart fingers of another electrode so that two neighboring fingers belong to different electrodes, the fingers of each electrode having at least one protrusion extending away from lateral sides of the fingers within the finger gaps;

wherein each protrusion is slanted at a predetermined angle with respect to the direction of the finger from which the corresponding protrusion is extended, and directed towards a neighboring protrusion extending from the neighboring finger such that end edges of the neighboring protrusions extending from the neighboring fingers approximately face one another, thereby defining a protrusion gap between end edges of the facing protrusions; and wherein for each finger gap the protrusions located therewithin are slanted in opposite directions than the protrusions located within the neighboring finger gaps.

2. The antenna arrangement of claim 1 further comprising:

a DC bias configured for biasing said pair of electrodes; and a light source configured to direct a light beam at least onto the protrusion gaps between end edges of the facing protrusions, thereby generating a THz radiation beam emitted from said protrusion gaps.

3. The antenna arrangement of claim 1, wherein the protrusions are slanted 45 degrees and 135 degrees with respect to the direction of the corresponding elongate fingers.

4. The antenna arrangement of claim 1, wherein at least a part of the end edge of the protrusion extending away from a certain finger extends over at least a part of the end edge of the facing protrusion extending away from the adjacent finger.

5. The antenna arrangement of claim 1, wherein a place from which the protrusions extend from one lateral side of the fingers is shifted with respect to the place on the fingers from which the protrusions extend from another lateral side of the fingers.

6. The antenna arrangement of claim 1, wherein a place from which the protrusions extend from one lateral side of the fingers is the same for the protrusions extending from both lateral sides of the fingers.

7. The antenna arrangement of claim 1, wherein the fingers and the protrusions are planar strips provided on the planar surface of the substrate.

8. The antenna arrangement of claim 1, wherein the protrusions have a trapezoidal shape including a beveled end edge.

9. The antenna arrangement of claim 8, wherein the beveled end edge of the protrusion extending away from a certain finger extends over a beveled end edge of the neighboring protrusion extending away from the neighboring finger such that the beveled end edges corresponding to the neighboring protrusion approximately face one another.

10. The antenna arrangement of claim 7, wherein a width of the protrusions is greater than the width of the fingers.

11. The antenna arrangement of claim 1, further comprising a lens array located above the corresponding protrusion gap between the protrusions of the fingers.

12. The antenna arrangement of claim 11, wherein the lens array is configured such that focal points of the lenses are located in the center of the protrusion gaps.

13. The antenna arrangement of claim 11, wherein the lens array is impressed into a surface of a transparent plate that is placed above the antenna arrangement.

14. The antenna arrangement of claim 11, wherein the lens array includes plano-convex individual lenses mounted onto the antenna arrangement.

15. The antenna arrangement of claim 1, further comprising a THz lens attached to the non-metalized side of the substrate.

16. The antenna arrangement of claim 15, wherein said THz lens is a hyper-hemispherical lens designed such that the array phase center of the antenna arrangement is located at the aplanatic point of the lens.

* * * * *